US008901064B2

(12) United States Patent
Huchel et al.

(10) Patent No.: US 8,901,064 B2
(45) Date of Patent: Dec. 2, 2014

(54) MICROCAPSULE CONTAINING DETERGENT OR CLEANING AGENT

(71) Applicant: Henkel AG & Co. KGaA, Duesseldorf (DE)

(72) Inventors: Ursula Huchel, Cologne (DE); Andreas Bauer, Kaarst (DE); Matthias Sunder, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/789,778

(22) Filed: Mar. 8, 2013

(65) Prior Publication Data

US 2013/0203642 A1 Aug. 8, 2013

Related U.S. Application Data

(63) Continuation of application No. PCT/EP2011/065618, filed on Sep. 9, 2011.

(30) Foreign Application Priority Data

Sep. 10, 2010 (DE) ..... 10 2010 040 564

(51) Int. Cl.
*C11D 3/37* (2006.01)
*C11D 17/00* (2006.01)
*C11D 3/50* (2006.01)

(52) U.S. Cl.
CPC ..... *C11D 17/0039* (2013.01); *C11D 3/378* (2013.01); *C11D 3/505* (2013.01); *C11D 3/3715* (2013.01); *C11D 3/3765* (2013.01); *C11D 3/3788* (2013.01)
USPC ..... 510/438; 510/101; 510/296; 510/441; 510/445; 424/408; 424/490; 424/70.19

(58) Field of Classification Search
CPC ... C11D 3/502; C11D 3/3757; C11D 17/0039
USPC ..... 510/101, 296, 438, 441, 445; 424/408, 424/490, 70.19
See application file for complete search history.

(56) References Cited

U.S. PATENT DOCUMENTS

| | | | | |
|---|---|---|---|---|
| 3,726,803 | A | 4/1973 | Bayless et al. | |
| 5,162,486 | A | 11/1992 | Follmann et al. | |
| 6,951,836 | B2 * | 10/2005 | Jahns et al. | 510/441 |
| 2010/0323938 | A1 * | 12/2010 | Quellet et al. | 510/101 |

OTHER PUBLICATIONS

PCT International Search Report (PCT/EP2011/065618) dated Oct. 21, 2011.

* cited by examiner

*Primary Examiner* — Brian P Mruk
(74) *Attorney, Agent, or Firm* — Thomas G. Krivulka

(57) ABSTRACT

The invention relates to detergents or cleaning agents which comprise capsules that are low in formaldehydes and/or free from formaldehyde, are storage stable and thus prevent a contamination of the detergent or cleaning agent with formaldehyde, comprising microcapsules, the capsule wall of which contains a resin which is obtained by reacting at least one aromatic alcohol or ether or derivative thereof and at least one aldehydic component which comprises at least two C-atoms per molecule, and optionally at least one (meth)acrylate-polymer, and builders and/or surfactants. Said detergent or cleaning agents enable, during application, a targeted and durable release of liquid active agents, such as, in particular scents, to the treated objects.

10 Claims, No Drawings

MICROCAPSULE CONTAINING DETERGENT OR CLEANING AGENT

FIELD OF THE INVENTION

The present invention generally relates to washing or cleaning agents and relates to washing or cleaning agents, which comprise special microcapsules, as well as methods for preparing washing or cleaning agents, which comprise microcapsules.

BACKGROUND OF THE INVENTION

Many washing or cleaning agents comprise sensitive ingredients, such as e.g. fragrances. The disadvantage is that these types of ingredients that are incorporated in such agents frequently lose their activity during storage and/or their activity is at least strongly diminished before the desired time of application, namely by chemical reactions as a result of interactions with other ingredients of the washing or cleaning agent and/or due to physical factors. On these grounds an encapsulation of the ingredients can be advisable.

Numerous commercial encapsulation systems already exist which are based on natural or synthetic polymers. They can enclose an active agent or its solution and then be physically or chemically crosslinked in the shell or be precipitated out with another polymer by a coacervation process. Other encapsulation methods by liposomes exist, e.g. "Nanotopes" from Ciba-Geigy, or sponge-like particles such as "Microsponges" from Advanced Polymer Systems. Micro-encapsulated molded objects, for example, are employed to increase the stability of pharmaceutical active agents, to influence taste, for the release of active agents targeted at specific organs and to avoid incompatibilities with other adjuvants and active agents. Moreover, microcapsules are used in adhesive technology. Furthermore, fragrance capsules are also known with gelatin as the wall material, from which the perfume oils are released by means of mechanical destruction. Apart from "real" microcapsules that possess a shell/core structure, there exist spherical carrier particles e.g. of alginate, gelatin or polyvinyl alcohol (PVAl) into which an active agent, living cells or enzymes can be embedded. These capsules can be manufactured e.g. by a prilling process. In general microcapsules are particles with a diameter of <1 mm. Besides the inclusion in capsules of various sizes, substances can also be adsorbed onto suitable carrier materials or be chemically modified.

Microcapsules that can comprise liquid, solid or gaseous substances as the core material are known from the prior art. For example, phenol-formaldehyde polymers, melamine-formaldehyde polymers, polyurethane, gelatin, polyamides or polyureas can be used as the material for the capsule walls.

Washing or cleaning agents that comprise microcapsules are also known. Due to their particular stability, microcapsules made of melamine-formaldehyde resins have proven their worth in washing or cleaning agents. There is, however, a problem, in that in the manufacture of these microcapsules, the obtained capsule dispersions basically still include residual free formaldehyde, the presence of which, in further processing or in the end product that is supplied to the consumer, is undesirable. Consequently, the patent literature contains proposals to lower the formaldehyde content by adding formaldehyde scavengers.

EP-A 0 415 273 describes the manufacture and use of mono and polydisperse solid spherical particles of melamine-formaldehyde condensate. The use of ammonia, urea or ethylene urea is proposed so as to bind the formaldehyde released during the condensation.

The formaldehyde content of the dispersion is usually lowered by adding the cited formaldehyde scavengers to the microcapsule dispersion or during the manufacture of the microcapsule dispersion. However, the formaldehyde content of products that comprise this type of microcapsule dispersions or which are treated with them, often cannot be reduced below a certain level—even by adding large quantities of formaldehyde scavengers.

Therefore, the object of the present invention was to provide microcapsule-containing washing or cleaning agents that comprise microcapsules, which involve the lowest possible amount of formaldehyde or in which the use of formaldehyde for microcapsules is preferably totally avoided.

It was surprisingly found that certain capsule materials in washing or cleaning agents provide exceptionally stable capsules and moreover totally exclude contamination of the washing or cleaning agent with formaldehyde.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A washing or cleaning agent, comprising surfactants and/or builders, as well as microcapsules, whose capsule walls contain a resin that is obtained by reacting at least one aromatic alcohol or its ethers or derivatives with at least one aldehydic component that possesses at least two carbon atoms per molecule, and optionally in the presence of at least one (meth)acrylate polymer.

A process for manufacturing a liquid laundry or cleaning agent wherein a microcapsule dispersion that contains microcapsules, whose capsule walls contain a resin that is obtained by reacting at least one aromatic alcohol or its ethers or derivatives with at least one aldehydic component that possesses at least two carbon atoms per molecule, and optionally in the presence of at least one (meth)acrylate polymer, is stirred into the liquid laundry or cleaning agent matrix or the cited microcapsule dispersion is continuously added to a liquid laundry or cleaning agent matrix and blended with static mixing elements, wherein surfactant was preferably added beforehand to the microcapsule dispersion.

A process for manufacturing a solid washing or cleaning agent wherein (a) a microcapsule dispersion encompassing microcapsules, whose capsule walls contain a resin that is obtained by reacting at least one aromatic alcohol or its ethers or derivatives with at least one aldehydic component that possesses at least two carbon atoms per molecule, and optionally in the presence of at least one (meth)acrylate polymer, is added to the rest of the laundry or cleaning agent matrix, or the cited microcapsules in granulated or supported form are added to the rest of the washing or cleaning agent matrix, or the cited microcapsules in dried form are added to the rest of the washing or cleaning agent matrix.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A first subject matter of the present invention is a washing or cleaning agent, comprising i. surfactants and/or builders, in particular in a total amount of 0.01 to 80 wt %, based on the total agent, and ii. microcapsules, whose capsule walls contain a resin that is obtainable by treating a) at least one aromatic alcohol or its ethers or derivatives with b) at least one aldehydic component that possesses at least two carbon atoms per molecule, and optionally in the presence of at least one (meth)acrylate polymer.

The washing or cleaning agents according to the invention have the advantage that they possess at most a quite low formaldehyde content due to the fact that their manufacture involves at most a quite low, but especially no formaldehyde addition at all. The washing or cleaning agents according to the invention afford the controlled release of active agents, especially fragrances that are stored in the capsules. The capsules are stable within the washing or cleaning agent matrix and can be opened by means of specific stimulation, especially by mechanical force. When the washing or cleaning agent is used, e.g. when washing textiles, the microcapsules are deposited on the washing to be cleaned and after the washing has been dried can be easily opened e.g. by rubbing. A controlled release of active agent is realized in this way, such that the performance profile of the agent as a whole is increased. In this regard, particular significance is attributed especially to the fragrance effect, as in many cases the consumer judges the product performance as a function of the pleasant aroma. However, the release of the active agents, especially fragrances, can also occur by a diffusion process, in which the active agents, especially fragrances, migrate through the polymeric shell material and are then slowly released. The incorporation of the micro-encapsulated active agents, especially fragrances, to the washing or cleaning agent provides in particular a long-lasting release of the active agents, in particular a long-lasting fragrance to the washing to be cleaned as well as a controlled release of the active agents, in particular a release of fragrance, even after long periods of time.

The inventively applicable microcapsules are comprised in the washing or cleaning agent in amounts of preferably 0.0001 to 50 wt %, advantageously 0.001 to 40 wt %, more advantageously 0.005 to 30 wt %, even more advantageously 0.01 to 20 wt %, further advantageously 0.05 to 10 wt % and especially 0.1 to 5 wt %, relative to the agent as a whole.

The microcapsules especially comprise liquid, preferably containing i. fragrances (perfume oils)

ii. liquid constituents of washing and cleaning agents, such as preferably surfactants, particularly non-ionic surfactants, silicone oils, paraffins iii. liquid non-pharmaceutical additives or active agents, e.g. oils such as for example almond oil or cooling substances, mixtures of the above.

However, it is mostly preferred for the microcapsules to comprise fragrances (perfume oils). In the context of this invention, the terms "perfumes" and "fragrances" are used synonymously.

The usable microcapsules are described below in more detail.

In the context of the present invention, aryloxyalkanols, arylalkanols and oligoalkanol aryl ethers are preferred as the aromatic alcohols ii)a. Aromatic compounds are likewise preferred in which at least one free hydroxyl group, particularly preferably at least two free hydroxyl groups, are directly bound to the aromatic ring, wherein particularly preferably at least two free hydroxyl groups are directly bound to an aromatic ring and quite particularly preferably are meta to one another. The aromatic alcohols are preferably selected from phenols, cresols (o-, m- and p-cresol), naphthols (α- and β-naphthol) and thymol, as well as from ethylphenols, propylphenols, fluorophenols and methoxyphenols.

Inventively preferred aromatic alcohols are moreover those used for the manufacture of polycarbonate plastics (e.g. for compact discs, plastic dishes, baby bottles) and epoxy resin paints (e.g. for coatings of cans and film packaging), in particular 2,2-bis-(4-hydroxyphenyl)-propane (Bisphenol A).

The aromatic alcohol is quite particularly preferably selected from the phenols with two or more hydroxyl groups, preferably from pyrocatechol, resorcinol, hydroquinone and 1,4-naphthohydroquinone, phloroglucine, pyrogallol, hydroxyhydroquinone, wherein resorcinol and/or phloroglucine are particularly preferred as the aromatic alcohols.

In summary, preferred compositions according to the invention are those, in which at least one aromatic alcohol ii)a) is selected from phenols, cresols (o-, m- and p-cresol), naphthols (α- and β-naphthol), thymol, pyrocatechol, resorcinol, hydroquinone and 1,4-naphthohydroquinone, phloroglucin, pyrogallol, hydroxyhydroquinone.

In another embodiment of the present invention, the washing or cleaning agents comprise microcapsules, in whose manufacture the aromatic alcohol is added as an ether, wherein the ether is especially a derivative of the relevant free form of the aromatic alcohol ii)a) that is to be inventively treated. In this regard the free alcohol may also be present; therefore a mixture is present in this case. In this case the molar ratio between the free form of the aromatic alcohol to be inventively treated and the cited additional component (ether form of the aromatic alcohol) can preferably be between 0:100, preferably 1:1, or 1:2 or 1:4.

The advantage of the mixture of aromatic alcohol with an ether form is that the reactivity of the system can thereby be influenced. With the suitable choice of the ratio a system can be especially made, whose reactivity is appropriately attuned to the storage stability of the system. Esters are preferred as the derivatives of the aromatic alcohols.

According to the present invention, both aliphatic as well as aromatic aldehydes are preferred as the aldehyde ii)b) with 2 carbon atoms. Particularly preferred aldehydes are one or more selected from the group of valeraldehyde, capronaldehyde, caprylaldehyde, decanal, succindialdehyde, cyclohexane carbaldehyde, cyclopentane carbaldehyde, 2-methyl-1-propanal, 2-methylpropionaldehyde, acetaldehyde, acrolein, aldosterone, antimycin A, 8'-apo-β-caroten-8'-al, benzaldehyde, butanal, chloral, citral, citronellal, crotonaldehyde, dimethylaminobenzaldehyde, folic acid, fosmidomycin, furfural, glutaraldehyde, glycerin aldehyde, glycolaldehyde, glyoxal, glyoxylic acid, heptanal, 2-hydroxybenzaldehyde, 3-hydroxybutanal, hydroxymethylfurfural, 4-hydroxynonenal, isobutanal, iso-butyraldehyde, methacrolein, 2-methylundecanal, mucochloric acid, N-methylformamide, 2-nitrobenzaldehyde, nonanal, octanal, oleocanthal, orlistat, pentanal, phenylethanal, phycocyanin, piperonal, propanal, propenal, protocatechualdehyde, retinal, salicyl aldehyde, secologanin, streptomycin, strophanthidin, tylosin, vanillin, cinnamic aldehyde.

In the context of the present invention, the aldehydic component can possess at least one or two, particularly preferably two, three or four, in particular two free aldehyde groups per molecule, wherein it is preferred when at least glyoxal, glutardialdehyde and/or succindialdehyde, particularly preferably glutardialdehyde, is present as the aldehydic component.

In the inventively usable microcapsules the molar ratio of a) the at least one aromatic alcohol or (ether or derivative thereof), to b) the at least one aldehydic component can generally be between 1:1 and 1:5, particularly preferably between 1 to 2 and 1 to 3 and quite particularly preferably for resorcinol at about 1 to 2.6. The weight ratio of the components a)+b) to c), i.e. the ratio of the sum of the weights of a)+b) to the weight of the component c) is generally between 1:1 and 1:0.01, particularly preferably between 1:0.2 and 1:0.05.

In summary, those inventive compositions are preferred in which the aldehydic component ii)b) is selected from valeraldehyde, capronaldehyde, caprylaldehyde, decanal, succindialdehyde, cyclohexane carbaldehyde, cyclopentane carbaldehyde, 2-methyl-1-propanal, 2-methylpropionaldehyde, acetaldehyde, acrolein, aldosterone, antimycin A, 8'-apo-β-caroten-8'-al, benzaldehyde, butanal, chloral, citral, citronellal, crotonaldehyde, dimethylaminobenzaldehyde, folic acid, fosmidomycin, furfural, glutaraldehyde, glycerin aldehyde, glycolaldehyde, glyoxal, glyoxylic acid, heptanal, 2-hydroxybenzaldehyde, 3-hydroxybutanal, hydroxymethylfurfural, 4-hydroxynonenal, isobutanal, iso-butyraldehyde, methacrolein, 2-methylundecanal, mucochloric acid, N-methylformamide, 2-nitrobenzaldehyde, nonanal, octanal, oleocanthal, orlistat, pentanal, phenylethanal, phycocyanin, piperonal, propanal, propenal, protocatechualdehyde, retinal, salicyl aldehyde, seeologanin, streptomycin, strophanthidin, tylosin, vanillin, cinnamic aldehyde.

The optionally used (meth)acrylate polymers can be homopolymers or copolymers of methacrylate monomers and/or acrylate monomers. The term "(meth)acrylate" in this invention designates both methacrylates and acrylates. The (meth)acrylate polymers are e.g. homopolymers or copolymers, preferably copolymers, of one or more polar functionalized (meth)acrylate monomers, such as sulfonic acid group-containing, carboxylic acid group-containing, phosphoric acid group-containing, nitrile group-containing, phosphonic acid group-containing, ammonium group-containing, amine group-containing or nitrate group-containing (meth)acrylate monomers. In this regard, the polar groups can also be in salt form. The (meth)acrylate polymers are suitable as protective colloids and can be advantageously used in the manufacture of microcapsules.

(Meth)acrylate copolymers can consist for example of two or more (meth)acrylate monomers (e.g. acrylate+2-acrylamido-2-methyl-propane sulfonic acid) or one or more (meth) acrylate monomers and one or more monomers that differ from (meth)acrylate monomers (e.g. methacrylate+styrene).

Exemplary (meth)acrylate polymers are homopolymers of sulfonic acid group-containing (meth)acrylates (e.g. 2-acrylamido-2-methyl-propane sulfonic acid or its salts (AMPS), commercially available as Lupasol®PA 140, BASF), or its copolymers, copolymers of acrylamide and (meth)acrylic acid, copolymers of alkyl (meth)acrylates and N-vinyl pyrrolidone (commercially available as Luviskol®K15, K30 or K90, BASF), copolymers von (meth)acrylates with polycarboxylates or polystyrene sulfonates, copolymers of (meth) acrylates with vinyl ethers and/or maleic anhydride, copolymers of (meth)acrylates with ethylene and/or maleic anhydride, copolymers of (meth)acrylates with isobutylene and/or maleic anhydride, or copolymers of (meth)acrylates with styrene-maleic anhydride.

Preferred (meth)acrylate polymers are homopolymers or copolymers, preferably copolymers, of 2-acrylamido-2-methyl-propane sulfonic acid or its salts (AMPS). Copolymers of 2-acrylamido-2-methyl-propane sulfonic acid or its salts are preferred, e.g. copolymers with one or more comonomers from the group of (meth)acrylates, vinyl compounds such as vinyl esters or styrenes, unsaturated di or polycarboxylic acids such as maleic acid esters, or salts of amyl compounds or allyl compounds. Preferred comonomers for AMPS are cited below; these comonomers can, however, also be copolymerized with other polar functionalized (meth)acrylate monomers:

1) vinyl compounds, e.g. vinyl esters such as vinyl acetate, vinyl laurate, vinyl propionate or vinyl esters of neononanoic acid, or aromatic vinyl compounds such as styrene comonomers, for example styrene, alpha-methylstyrene or polar functionalized styrenes such as styrenes with hydroxy, amino, nitrile, carbonic acid, phosphonic acid, phosphoric acid, nitro or sulfonic acid groups and their salts, wherein the styrenes are preferably polar functionalized in the para position.
2) unsaturated di or polycarboxylic acids, e.g. maleic acid esters such as dibutyl maleate or dioctyl maleate, as salts of allyl compounds e.g. sodium allyl sulfonate, as the salts of amyl derivatives e.g. sodium amyl sulfonate.
3) (meth)acrylate comonomers; these are esters of acrylic acid and methacrylic acid, wherein the ester groups are e.g. saturated or unsaturated, straight chain, branched or cyclic hydrocarbon groups that can comprise one or more heteroatoms such as N, O, S, P, F, Cl, Br, I. Examples of such hydrocarbon groups are straight chain, branched or cyclic alkyl, straight chain, branched or cyclic alkenyl, aryl such as phenyl or heterocyclyl such as tetrahydrofurfuryl.

Exemplary (meth)acrylate comonomers, preferably for AMPS, are:

a) acrylic acid, $C_1$-$C_{14}$ alkyl acrylic acids such as methacrylic acid,
b) (meth)acrylamides such as acrylamide, methacrylamide, diacetone acrylamide, diacetone methacrylamide, N-butoxymethylacrylamide, N-iso-butoxymethylacrylamide, N-butoxymethylmethacrylamide, N-iso-butoxymethylmethacrylamide, N-methylolacrylamide, N-methylolmethacryl amide;
c) heterocyclic (meth)acrylates such as tetrahydrofurfuryl acrylate and tetrahydrofurfuryl methacrylate or carbocyclic (meth)acrylates such as isobornyl acrylate and isobornyl methacrylate,
d) urethane (meth)acrylates such as diurethane diacrylate and diurethane methacrylate (CAS: 72869-86-4)
e) $C_1$-$C_{14}$ alkyl acrylates such as methyl, ethyl, n-propyl, isopropyl, n-butyl, sec. butyl, iso-butyl, tert. butyl, n-pentyl, iso-pentyl, hexyl (e.g. n-hexyl, iso-hexyl or cyclohexyl), heptyl, octyl (e.g. 2-ethylhexyl), nonyl, decyl (e.g. 2-propylheptyl or iso-decyl), undecyl, dodecyl, tridecyl (e.g. iso-tridecyl), and tetradecyl acrylate; the alkyl groups can optionally be substituted with one or more halogen atoms (e.g. fluorine, chlorine, bromine or iodine), e.g. trifluoromethyl acrylate, or with one or more amino groups, e.g. diethylaminoethyl acrylate, or with one or more alkoxy groups such as methoxypropyl acrylate, or with one or more aryloxy groups such as phenoxyethyl acrylate.
f) $C_2$-$C_{14}$ alkenyl acrylates such as ethenyl, n-propenyl, isopropenyl, n-butenyl, sec. butenyl, iso-butenyl, tert. butenyl, n-pentenyl, iso-pentenyl, hexenyl (e.g. n-hexenyl, iso-hexenyl or cyclohexenyl), heptenyl, octenyl (e.g. 2-ethylhexenyl), nonenyl, decenyl (e.g. 2-propenylheptyl or iso-decenyl), undecenyl, dodecenyl, tridecenyl (e.g. iso-tridecenyl), and tetradecenyl acrylate, and their epoxides such as glycidyl acrylate or aziridines such as aziridine acrylate.
g) $C_1$-$C_{14}$ hydroxyalkyl acrylates such as hydroxymethyl, hydroxyethyl, hydroxy-n-propyl, hydroxy-isopropyl, hydroxy-n-butyl, hydroxy-sec.-butyl, hydroxy-iso-butyl, hydroxy-tert.-butyl, hydroxy-n-pentyl, hydroxy-iso-pentyl, hydroxyhexyl (e.g. hydroxy-n-hexyl, hydroxy-iso-hexyl or hydroxy-cyclohexyl), hydroxyheptyl, hydroxyoctyl (e.g. 2-ethylhexyl), hydroxynonyl, hydroxydecyl (e.g. hydroxy-2-propylheptyl or hydroxy-iso-decyl), hydroxyundecyl, hydroxydodecyl, hydroxytridecyl (e.g. hydroxy-iso-tridecyl), and hydroxytetradecyl acrylate, wherein the hydroxyl group of the alkyl group is preferably in the terminal position (ω-position) (e.g. 4-hydroxy-n-butyl acrylate) or in the (ω-1)-position (e.g. 2-hydroxy-n-propyl acrylate);

h) alkylene glycol acrylates, which comprise one or more alkylene glycol units. Examples are i) monoalkylene glycol acrylates, such as acrylates of ethylene glycol, propylene glycol (e.g. 1,2- or 1,3-propane diol), butylene glycol (e.g. 1,2-, 1,3- or 1,4-butane diol, pentylene glycol (e.g. 1,5-pentane diol) or hexylene glycol (e.g. 1,6-hexane diol), in which the second hydroxyl group is etherified or esterified, e.g. by sulfuric acid, phosphoric acid, acrylic acid or methacrylic acid, or ii) polyalkylene glycol acrylates such as polyethylene glycol acrylates, polypropylene glycol acrylates, polybutylene glycol acrylates, polypentylene glycol acrylates or polyhexylene glycol acrylates, whose second hydroxyl group can be optionally etherified or esterified, e.g. by sulfuric acid, phosphoric acid, acrylic acid or methacrylic acid;

Examples of (poly)alkylene glycol units with etherified hydroxyl groups are $C_1$-$C_{14}$ alkyloxy-(poly)alkylene glycols (e.g. $C_1$-$C_{14}$ alkyloxy-polyalkylene glycol acrylates), examples of (poly)alkylene glycol units with esterified hydroxyl groups are sulfonium-(poly)alkylene glycols (e.g. sulfonium-(poly)alkylene glycol acrylates) and their salts, (poly)alkylene glycol diacrylates such as 1,4-butane diol diacrylate or 1,6-hexane diol diacrylate or (poly)alkylene glycol methacrylate acrylates such as 1,4-butane diol methacrylate acrylate or 1,6-hexane diol methacrylate acrylate.

The polyalkylene glycol acrylates can carry an acrylate group (e.g. polyethylene glycol monoacrylate, polypropylene glycol monoacrylate, polybutylene glycol monoacrylate, polypentylene glycol monoacrylate or polyhexylene glycol monoacrylate) or two or more, preferably two, acrylate groups such as polyethylene glycol diacrylate, polypropylene glycol diacrylate, polybutylene glycol diacrylate, polypentylene glycol diacrylate or polyhexylene glycol diacrylate.

The polyalkylene glycol acrylates can also comprise two or more polyalkylene glycol blocks that differ from each other, e.g. blocks of polymethylene glycol and polyethylene glycol or blocks of polyethylene glycol and polypropylene glycol.

The degree of polymerization of the polyalkylene glycol units or polyalkylene glycol blocks is generally in the range of 1 to 20, preferably in the range 3 to 10, particularly preferably in the range of 3 to 6.

i) $C_1$-$C_{14}$ alkyl methacrylates such as methyl, ethyl, n-propyl, isopropyl, n-butyl, sec. butyl, iso-butyl, tert. butyl, n-pentyl, iso-pentyl, hexyl (e.g. n-hexyl, iso-hexyl or cyclohexyl), heptyl, octyl (e.g. 2-ethylhexyl), nonyl, decyl (e.g. 2-propylheptyl or iso-decyl), undecyl, dodecyl, tridecyl (e.g. iso-tridecyl), and tetradecyl methacrylate; the alkyl groups can optionally be substituted with one or more halogen atoms (e.g. fluorine, chlorine, bromine or iodine), e.g. trifluoromethyl methacrylate, or with one or more amino groups, e.g. diethylaminoethyl methacrylate, or with one or more alkoxy groups such as methoxypropyl methacrylate, or with one or more aryloxy groups such as phenoxyethyl methacrylate.

j) $C_2$-$C_{14}$ alkenyl methacrylates such as ethenyl, n-propenyl, iso-propenyl, n-butenyl, sec. butenyl, iso-butenyl, tert. butenyl, n-pentenyl, iso-pentenyl, hexenyl (e.g. n-hexenyl, iso-hexenyl or cyclohexenyl), heptenyl, octenyl (e.g. 2-ethylhexenyl), nonenyl, decenyl (e.g. 2-propenylheptyl or iso-decenyl), undecenyl, dodecenyl, tridecenyl (e.g. iso-tridecenyl), and tetradecenyl methacrylate, and their epoxides such as glycidyl methacrylate or aziridines such as aziridine methacrylate.

k) $C_1$-$C_{14}$ hydroxyalkyl methacrylates such as hydroxymethyl, hydroxyethyl, hydroxy-n-propyl, hydroxy-iso-propyl, hydroxy-n-butyl, hydroxy-sec.-butyl, hydroxy-iso-butyl, hydroxy-tert.-butyl, hydroxy-n-pentyl, hydroxy-iso-pentyl, hydroxyhexyl (e.g. hydroxy-n-hexyl, hydroxy-iso-hexyl or hydroxy-cyclohexyl), hydroxyheptyl, hydroxyoctyl (e.g. 2-ethylhexyl), hydroxynonyl, hydroxydecyl (e.g. hydroxy-2-propylheptyl or hydroxy-iso-decyl), hydroxyundecyl, hydroxydodecyl, hydroxytridecyl (e.g. hydroxy-iso-tridecyl), and hydroxytetradecyl methacrylate, wherein the hydroxyl group of the alkyl group is preferably in the terminal position (ω-position) (e.g. 4-hydroxy-n-butyl methacrylate) or in the (ω-1)-position (e.g. 2-hydroxy-n-propyl methacrylate);

l) alkylene glycol methacrylates that comprise one or more alkylene glycol units. Examples are i) monoalkylene glycol methacrylates, such as methacrylates of ethylene glycol, propylene glycol (e.g. 1,2- or 1,3-propane diol), butylene glycol (e.g. 1,2-, 1,3- or 1,4-butane diol, pentylene glycol (e.g. 1,5-pentane diol) or hexylene glycol (e.g. 1,6-hexane diol), in which the second hydroxyl group is etherified or esterified, e.g. by sulfuric acid, phosphoric acid, acrylic acid or methacrylic acid, or ii) polyalkylene glycol methacrylates such as polyethylene glycol methacrylates, polypropylene glycol methacrylates, polybutylene glycol methacrylates, polypentylene glycol methacrylates or polyhexylene glycol methacrylates, whose second hydroxyl group can be optionally etherified or esterified, e.g. by sulfuric acid, phosphoric acid, acrylic acid or methacrylic acid.

Examples of (poly)alkylene glycol units with etherified hydroxyl groups are $C_1$-$C_{14}$ alkyloxy (poly)alkylene glycols (e.g. $C_1$-$C_{14}$ alkyloxy polyalkylene glycol methacrylates), examples of (poly)alkylene glycol units with esterified hydroxyl groups are sulfonium-(poly)alkylene glycols (e.g. sulfonium-(poly)alkylene glycol methacrylates) and their salts or (poly)alkylene glycol dimethacrylates such as 1,4-butane diol dimethacrylate.

The polyalkylene glycol methacrylates can carry a methacrylate group (e.g. polyethylene glycol monomethacrylate, polypropylene glycol monomethacrylate, polybutylene glycol monomethacrylate, polypentylene glycol monomethacrylate or polyhexylene glycol monomethacrylate) or two or more, preferably two, methacrylate groups such as polyethylene glycol dimethacrylate, polypropylene glycol dimethacrylate, polybutylene glycol dimethacrylate, polypentylene glycol dimethacrylate or polyhexylene glycol dimethacrylate.

The polyalkylene glycol methacrylates can also comprise two or more polyalkylene glycol blocks that differ from each other, e.g. blocks of polymethylene glycol and polyethylene glycol or blocks of polyethylene glycol and polypropylene glycol (e.g. Bisomer PEM63PHD (Cognis), CAS 58916-75-9).

The degree of polymerization of the polyalkylene glycol units or polyalkylene glycol blocks is generally in the range of 1 to 20, preferably in the range 3 to 10, particularly preferably in the range of 3 to 6.

Exemplary preferred (meth)acrylate comonomers are 4-hydroxybutyl acrylate, 2-hydroxypropyl methacrylate, ammonium sulfatoethyl methacrylate, pentapropylene glycol methacrylate, acrylic acid, hexaethylene glycol methyacrylate, hexapropylene glycol acrylate, hexaethylene glycol acrylate, hydroxyethyl methacrylate, polyalkylene glycol methacrylate (CAS-Nr. 589-75-9), Bisomer PEM63PHD, methoxy polyethylene glycol methacrylate, 2-propylheptyl acrylate (2-PHA), 1,3-butane diol dimethacrylate (BDDMA), triethylene glycol dimethacrylate (TEGDMA), hydroxyethyl acrylate (HEA), 2-hydroxypropyl acrylate (HPA), ethylene glycol dimethacrylate (EGDMA), glycidyl methacrylate (GMA) and/or allyl methacrylate (ALMA).

The AMPS copolymers generally have a fraction of AMPS units that is greater than 50 mol %, preferably in the range 60-95 mol %, particularly preferably 80 to 99 mol %, the fraction of comonomers generally being less than 50 mol %, preferably in the range 5 to 40 mol %, particularly preferably 1 to 20 mol %.

The copolymers can be obtained by processes known per se, for example in batch or semi-batch processes. For example, appropriate amounts of water and monomers are first fed into a temperature controlled reactor and maintained under an atmosphere of inert gas. The mixture is then brought to the reaction temperature with stirring (preferably 70-80° C.), initiator is added, preferably in the form of an aqueous solution. Suitable initiators are the known initiators for radical polymerizations, for example the peroxydisulfates of sodium, potassium or ammonium, or mixtures based on $H_2O_2$, e.g. mixtures of $H_2O_2$ with citric acid. Once the maximum temperature has been attained and as the temperature in the reactor starts to fall either a) the remaining monomers are added and subsequently reacted (semi-batch process), or b) the next reaction is carried out directly (batch process). The resulting reaction mixture is then cooled down to room temperature and the copolymer is isolated from the aqueous solution, e.g. by extraction with organic solvents such as hexane or methylene chloride and subsequent distillation of the solvent. The copolymer can then be washed with organic solvent and dried. The reaction mixture can also be directly processed; in this case it is advantageous to add a preservative to the aqueous copolymer solution.

The AMPS copolymers are suitable as protective colloids for manufacturing the microcapsules that are usable according to the present invention.

In summary, inventive compositions are preferred, in which the (meth)acrylate polymer is a copolymer of 2-acrylamido-2-methyl-propane sulfonic acid or its salts with one or more further (meth)acrylate monomers, selected from the group of the (meth)acrylates, the vinyl compounds, the unsaturated di or polycarboxylic acids and the salts of amyl compounds or allyl compounds.

In particularly preferred inventive compositions, the molar ratio of the at least one aromatic alcohol ii)a) to the at least one aldehydic component ii)b) that possesses at least two carbon atoms per molecule is between 1 to 2 and 1 to 3.5, preferably between 1 to 2.4 and 1 to 2.8 and particularly preferably is 1 to 2.6.

Preferred inventive washing or cleaning agents comprise microcapsules that possess the following components 11)a), ii)b) and ii)c):

phloroglucinol, glutardialdehyde, AMPS/hydroxyethyl methacrylate copolymer;
phloroglucinol, succindialdehyde, AMPS/hydroxyethyl methacrylate copolymer;
phloroglucinol, glyoxal, AMPS/hydroxyethyl methacrylate copolymer;
phloroglucinol, glutardialdehyde, AMPS/hydroxyethyl acrylate copolymer;
phloroglucinol, succindialdehyde, AMPS/hydroxyethyl acrylate copolymer;
phloroglucinol, glyoxal, AMPS/hydroxyethyl acrylate copolymer;
phloroglucinol, glutardialdehyde, AMPS/hydroxypropyl methacrylate copolymer;
phloroglucinol, succindialdehyde, AMPS/hydroxypropyl methacrylate copolymer;
phloroglucinol, glyoxal, AMPS/hydroxypropyl methacrylate copolymer;
phloroglucinol, glutardialdehyde, AMPS/hydroxypropyl acrylate copolymer;
phloroglucinol, succindialdehyde, AMPS/hydroxypropyl acrylate copolymer;
phloroglucinol, glyoxal, AMPS/hydroxypropyl acrylate copolymer;
phloroglucinol, glutardialdehyde, AMPS/hydroxybutyl methacrylate copolymer;
phloroglucinol, succindialdehyde, AMPS/hydroxybutyl methacrylate copolymer;
phloroglucinol, glyoxal, AMPS/hydroxybutyl methacrylate copolymer;
phloroglucinol, glutardialdehyde, AMPS/hydroxybutyl acrylate copolymer;
phloroglucinol, succindialdehyde, AMPS/hydroxybutyl acrylate copolymer;
phloroglucinol, glyoxal, AMPS/hydroxybutyl acrylate copolymer;
phloroglucinol, glutardialdehyde, AMPS/polyethylene glycol mono methacrylate copolymer;
phloroglucinol, succindialdehyde, AMPS/polyethylene glycol mono methacrylate copolymer;
phloroglucinol, glyoxal, AMPS/polyethylene glycol mono methacrylate copolymer;
phloroglucinol, glutardialdehyde, AMPS/polyethylene glycol mono acrylate copolymer;
phloroglucinol, succindialdehyde, AMPS/polyethylene glycol mono acrylate copolymer;
phloroglucinol, glyoxal, AMPS/polyethylene glycol mono acrylate copolymer;
phloroglucinol, glutardialdehyde, AMPS/polypropylene glycol mono methacrylate copolymer;
phloroglucinol, succindialdehyde, AMPS/polypropylene glycol mono methacrylate copolymer;
phloroglucinol, glyoxal, AMPS/polypropylene glycol mono methacrylate copolymer;
phloroglucinol, glutardialdehyde, AMPS/polypropylene glycol mono acrylate copolymer;
phloroglucinol, succindialdehyde, AMPS/polypropylene glycol mono acrylate copolymer;
phloroglucinol, glyoxal, AMPS/polypropylene glycol mono acrylate copolymer;
phloroglucinol, glutardialdehyde, AMPS/methoxy polyethylene glycol mono methacrylate copolymer;
phloroglucinol, succindialdehyde, AMPS/methoxy polyethylene glycol mono methacrylate copolymer;
phloroglucinol, glyoxal, AMPS/methoxy polyethylene glycol mono methacrylate copolymer;
phloroglucinol, glutardialdehyde, AMPS/methoxy polyethylene glycol mono acrylate copolymer;
phloroglucinol, succindialdehyde, AMPS/methoxy polyethylene glycol mono acrylate copolymer;
phloroglucinol, glyoxal, AMPS/methoxy polyethylene glycol mono acrylate copolymer;

resorcinol, glutardialdehyde, AMPS/hydroxyethyl methacrylate copolymer;
resorcinol, succindialdehyde, AMPS/hydroxyethyl methacrylate copolymer;
resorcinol, glyoxal, AMPS/hydroxyethyl methacrylate copolymer;
resorcinol, glutardialdehyde, AMPS/hydroxyethyl acrylate copolymer;
resorcinol, succindialdehyde, AMPS/hydroxyethyl acrylate copolymer;
resorcinol, glyoxal, AMPS/hydroxyethyl acrylate copolymer;
resorcinol, glutardialdehyde, AMPS/hydroxypropyl methacrylate copolymer;
resorcinol, succindialdehyde, AMPS/hydroxypropyl methacrylate copolymer;
resorcinol, glyoxal, AMPS/hydroxypropyl methacrylate copolymer;
resorcinol, glutardialdehyde, AMPS/hydroxypropyl acrylate copolymer;
resorcinol, succindialdehyde, AMPS/hydroxypropyl acrylate copolymer;
resorcinol, glyoxal, AMPS/hydroxypropyl acrylate copolymer;
resorcinol, glutardialdehyde, AMPS/hydroxybutyl methacrylate copolymer;
resorcinol, succindialdehyde, AMPS/hydroxybutyl methacrylate copolymer;
resorcinol, glyoxal, AMPS/hydroxybutyl methacrylate copolymer;
resorcinol, glutardialdehyde, AMPS/hydroxybutyl acrylate copolymer;
resorcinol, succindialdehyde, AMPS/hydroxybutyl acrylate copolymer;
resorcinol, glyoxal, AMPS/hydroxybutyl acrylate copolymer;
resorcinol, glutardialdehyde, AMPS/polyethylene glycol mono methacrylate copolymer;
resorcinol, succindialdehyde, AMPS/polyethylene glycol mono methacrylate copolymer;
resorcinol, glyoxal, AMPS/polyethylene glycol mono methacrylate copolymer;
resorcinol, glutardialdehyde, AMPS/polyethylene glycol mono acrylate copolymer;
resorcinol, succindialdehyde, AMPS/polyethylene glycol mono acrylate copolymer;
resorcinol, glyoxal, AMPS/polyethylene glycol mono acrylate copolymer;
resorcinol, glutardialdehyde, AMPS/polypropylene glycol mono methacrylate copolymer;
resorcinol, succindialdehyde, AMPS/polypropylene glycol mono methacrylate copolymer;
resorcinol, glyoxal, AMPS/polypropylene glycol mono methacrylate copolymer;
resorcinol, glutardialdehyde, AMPS/polypropylene glycol mono acrylate copolymer;
resorcinol, succindialdehyde, AMPS/polypropylene glycol mono acrylate copolymer;
resorcinol, glyoxal, AMPS/polypropylene glycol mono acrylate copolymer;
resorcinol, glutardialdehyde, AMPS/methoxy polyethylene glycol mono methacrylate copolymer;
resorcinol, succindialdehyde, AMPS/methoxy polyethylene glycol mono methacrylate copolymer;
resorcinol, glyoxal, AMPS/methoxy polyethylene glycol mono methacrylate copolymer;
resorcinol, glutardialdehyde, AMPS/methoxy polyethylene glycol mono acrylate copolymer;
resorcinol, succindialdehyde, AMPS/methoxy polyethylene glycol mono acrylate copolymer;
resorcinol, glyoxal, AMPS/methoxy polyethylene glycol mono acrylate copolymer.

In another embodiment of the invention, one or more nitrogen-containing or silicon dioxide-containing agents can be additionally used for manufacturing the inventively usable microcapsules. In this regard, the nitrogen-containing agents can be polymerized into the resin (e.g. in order to perfect the property profile of the resin) or used for the post-treatment.

Here, heterocyclic compounds are preferably used that possess at least one nitrogen atom as the heteroatom that neighbors either an amino-substituted carbon atom or a carbonyl group, such as for example pyridazine, pyrimidine, pyrazine, pyrrolidone, aminopyridine and compounds derived therefrom. Advantageous compounds of this family are aminopyridine and compounds derived therefrom. In principle all aminopyridines are suitable, such as for example melamine, 2,6-diaminopyridine, substituted and dimeric aminopyridines and mixtures prepared from these compounds. Furthermore, polyamides and dicyandiamide, urea and its derivatives as well as pyrrolidone and compounds derived therefrom are advantageous. Exemplary suitable pyrrolidones are imidazolidinone and compounds derived therefrom, such as for example hydantoin, whose derivatives are particularly advantageous, allantoin and its derivatives being particularly advantageous among these compounds. Furthermore, triamino-1,3,5-triazine (melamine) and its derivatives are particularly advantageous.

It should be stressed in particular that in order to arrive at this preferred embodiment of the inventively usable microcapsules, the post-treatment concerns a "clean" post-treatment of the surface. In other words: in this preferred embodiment, the cited nitrogen-containing agent is not uniformly involved in the construction of the whole capsule wall, rather it is concentrated essentially on the external surface of the capsule wall. The post-treatment can also be effected with silica gel (in particular amorphous hydrophobic silica gel) or with aromatic alcohols a), wherein these are preferably added as slurries.

The inventively usable microcapsules are incorporated into the inventive washing or cleaning agent especially in the form of microcapsule dispersions that comprise one or more of the inventively usable microcapsules.

The microcapsules or microcapsule dispersions that are comprised in the inventive washing or cleaning agents are preferably manufactured by reacting together the at least one inventively reactive aromatic alcohol and the at least one inventively reactive aldehyde component that possesses at least two carbon atoms per molecule, optionally in the presence of at least one (meth)acrylate polymer, whereupon the capsules are subsequently cured by increasing the temperature. It is particularly preferred in this regard to increase the pH in the course of the process.

Preferably, in the context of such a process, initially a) the at least one aromatic alcohol and/or its derivative or ether and the at least one aldehydic component and optionally at least one (meth)acrylate polymer and at least one substance to be encapsulated are brought together at a temperature of 40 to 65° C. and a pH between 6 and 9, preferably 7 and 8.5, and
b) in a later process step at a temperature of 40 to 65° C., the pH is increased to more than 9, preferably between 9.5 and 11, wherein c) the capsules are subsequently cured by increasing the temperature to 60° C. to 110° C., preferably 70° C. to 90° C., especially 80° C.

However, if phloroglucinol is used as the alcohol component then curing is more advantageously carried out in acidic conditions; preferably the pH is then maximum 4, particularly preferably between 3 and 4, for example between 3.2-3.5.

The yield and quality of the inventively usable microcapsules or microcapsule dispersions can be influenced by the selected parameters of the temperature, the pH and/or the stirring speed. In particular, a too low temperature can lead to the formation of a less well-sealed capsule wall. The person skilled in the art can recognize this from a reduced yield as well as from a separation of core material as a condensate in the filter of the dryer. Having said that, care should be taken that the reaction rate is not too high, as otherwise only a little wall material is formed around the capsules, or too much free wall material is present outside the capsules. This free wall material can then exist as particles that are larger than the capsules.

The alkalinity can also be important for the quality of the inventively usable microcapsules. In addition in the context of the process control, the pH influences the tendency of the ingredients to gel. If the particle formation (step b) above) is carried out at a pH of 9 or below then the ingredients could gel. In an embodiment of the described process, the alkalinity is adjusted by using an alkali metal salt, preferably alkali metal carbonate, especially sodium carbonate. Sodium carbonate is preferred as the danger of gelling is reduced with it.

In the context of the described process, stirring can be carried out at the beginning of the reaction (process step a)) of the aromatic alcohol with the aldehydic component, wherein the stirring speed can be 500 to 2500 rpm, in particular 1000 to 2000 rpm. To the resulting pre-condensate the subsequently optional (meth)acrylate polymer and the substance to be encapsulated can be added. Preferably later, namely immediately before or during the increase in the alkalinity (process step b)), the stirring speed is increased, wherein it can then be at 3000 to 5000 rpm, especially 3500 to 4500 rpm, most preferably 4000 rpm. The thus increased stirring speed is preferably maintained until the viscosity values of the mixture drop, wherein after the viscosity decrease starts, the stirring speed is reduced, preferably to 500 to 2500 rpm, particularly preferably to 1000 to 2000 rpm. A premature reduction in the stirring speed can likewise lead to an unwanted gelling of the mixture. After the onset of the described viscosity decrease, stirring is preferably continued for at least 20 minutes, particularly preferably between 30 and 180 minutes, at a stirring speed of 1000 to 2000 rpm and a temperature of 40 to 65° C., before the capsules are cured in process step c) by increasing the temperature. In the present invention, this period after the onset of the described viscosity decrease and before the capsules are cured, is also called the quiescent period. The quiescent period can advantageously serve to achieve the pre-formation of sufficiently stable capsule walls, in other words to form capsule walls of sufficient stability such that no more core material escapes.

Solid spheres can also be manufactured, i.e. capsules that contain no core material. These solid spheres can have a diameter of less than 500 nm (preferably between 300 and 400 nm). They are preferably monodisperse solid spheres. In one embodiment, phloroglucinol can be used for manufacturing these solid spheres.

In general, the diameter of the microcapsules is in the range 1-1000 μm. In the context of the present invention, the term "microcapsule" also includes nanocapsules, i.e. capsules with a diameter <1 μm. However, the diameter of the capsules is preferably in the range 1 to 100 μm, preferably 2 to 50 μm. The wall thickness can be 0.05 to 10 μm for example.

The choice of the protective colloids and the bases and acids for a successful encapsulation covers a broad range, wherein preferred bases bring about catalytic effects in the reaction of the aromatic alcohols with the aldehydes. Both the formation of resols as well as the formation of Novolak-analogous capsule walls is possible.

In general, the capsules can be loaded with gaseous, liquid as well as solid materials. Hydrophobic materials are preferably incorporated. However, liquid substances are particularly preferred, especially fragrances, liquid ingredients of washing and cleaning agents, such as preferably surfactants, especially non-ionic surfactants, silicone oils, paraffins, liquid non-pharmaceutical additives or active agents, e.g. oils such as for example almond oil as well as mixtures of the above. However, it is mostly preferred for the microcapsules to comprise fragrances (perfume oils).

As fragrances or perfumes or perfume oils, all substances and mixtures known as these can be used. In the context of this invention, the terms "perfume(s)", "fragrances" and "perfume oil(s)" are used synonymously. In particular, they mean any substances or their mixtures that are perceived by humans and animals as an odor, in particular by humans as a pleasant odor. Perfumes, perfume oils or ingredients of perfume oil can be used as the fragrant components. Inventively, perfume oils or fragrances can be individual fragrant compounds, for example the synthetic products of the ester, ether, aldehyde, ketone, alcohol and hydrocarbon type. Fragrant compounds of the ester type are, for example, benzyl acetate, phenoxyethyl isobutyrate, p-tert-butylcyclohexyl acetate, linalyl acetate, dimethylbenzyl carbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate and jasmecyclate. The ethers include, for example, benzyl ethyl ether and ambroxan; the aldehydes include, for example, the linear alkanals containing 8 to 18 carbon atoms, citral, citronellal, citronellyloxyacetaldehyde, cyclamen aldehyde, lilial and bourgeonal; the ketones include, for example, the ionones, α-isomethyl ionone and methyl cedryl ketone; the alcohols include anethol, citronellol, eugenol, geraniol, linalool, phenylethyl alcohol and terpineol and the hydrocarbons include, above all, the terpenes, such as limonene and pinene. However, mixtures of various odoriferous substances, which together produce an attractive fragrant note, are preferably used. Perfume oils such as these may also contain natural perfume mixtures obtainable from vegetal sources, for example pine, citrus, jasmine, patchouli, rose or ylang-ylang oil. Also suitable are muscatel sage oil, chamomile oil, clove oil, melissa oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil.

Exemplary tenacious odorous substances that can be used in the context of the present invention are the ethereal oils such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiacum wood oil, Indian wood oil, helichrysum oil, ho oil, ginger oil, iris oil, cajuput oil, sweet flag oil, chamomile oil, camphor oil, Canoga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, Palma Rosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil. However, in the context of the present invention, the higher boiling or solid odoriferous substances of natural or synthetic origin can be used as tenacious odoriferous substances or mixtures thereof, namely fragrances. These compounds include the following compounds and their mixtures: ambrettolide, α-amyl-cinnamaldehyde, anethol, anisaldehyde, anis alcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valeriate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarone, p-methoxyacetophenone, methyl n-amyl ketone, methyl anthranilic acid methyl ester, p-methyl acetophenone, methyl chavicol, p-methyl quinoline, methyl β-naphthyl ketone, methyl-n-nonyl acetaldehyde, methyl n-nonyl ketone, muscone, β-naphthol ethyl ether, naphthol methyl ether, nerol, nitrobenzene, n-nonyl aldehyde, nonyl alcohol, n-octyl aldehyde, p-oxyacetophenone, pentadecanolide, β-phenylethyl alcohol, phenylacetaldehyde dimethyl acetal, phenylacetic acid, pulegone, safrol, isoamyl salicylate, methyl salicylate, hexyl salicylate, cyclohexyl salicylate, santalol, scatol, terpineol, thymine, thymol, γ-undecalactone, vanillin, veratrum aldehyde, cinnamaldehyde, cinnamyl alcohol, cinnamic acid, ethyl cinnamate, benzyl cinnamate.

The readily volatile odoriferous substances particularly include the low boiling odoriferous substances of natural or synthetic origin that can be used alone or in mixtures. Exemplary readily volatile odoriferous substances are alkyl isothiocyanates (alkyl mustard oils), butanedione, limonene, linalool, linalyl acetate and linalyl propionate, menthol, menthone, methyl n-heptenone, phellandrene, phenyl acetaldehyde, terpinyl acetate, citral, citronellal. Preferred usable (especially for encapsulation) odoriferous compounds of the aldehyde type are hydroxycitronellal (CAS 107-75-5), helional (CAS 1205-17-0), citral (5392-40-5), bourgeonal (18127-01-0), triplal (CAS 27939-60-2), ligustral (CAS 68039-48-5), vertocitral (CAS 68039-49-6), florhydral (CAS 125109-85-5), citronellal (CAS 106-23-0), citronellyloxyacetaldehyde (CAS 7492-67-3).

It is further preferred that the perfume to be encapsulated does not include 2-methyl-undecanal, decanal, benzeneacetaldehyde or 3-phenylprop-2-enal.

The microcapsules can preferably also comprise one or more (preferably liquid) skin care and/or skin protecting active agents. Skin-care active agents are all such active agents that lend a sensorial and/or cosmetic advantage to the skin. Skin-care active agents are preferably selected from the following substances:

a) waxes such as for example carnauba, spermaceti, beeswax, lanoline and/or derivatives of the same and others.
b) hydrophobic plant extracts
c) hydrocarbons such as for example squalene and/or squalane
d) higher fatty acids, preferably those containing at least 12 carbon atoms, for example lauric acid, stearic acid, behenic acid, myristic acid, palmitic acid, oleic acid, linoleic acid, linolenic acid, isostearic acid and/or polyunsaturated fatty acids and others.
e) higher fatty alcohols, preferably those containing at least 12 carbon atoms, for example lauryl alcohol, cetyl alcohol, stearyl alcohol, oleyl alcohol, behenyl alcohol, cholesterol and/or 2-hexadecanol and others.
f) esters, preferably those such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactates, alkyl citrates and/or alkyl tartrates and others.
g) lipids such as for example cholesterol, ceramides and/or saccharose esters and others.
h) vitamins such as for example vitamins A, C and E, vitamin alkyl esters, including vitamin C alkyl esters and others.)
(i) sunscreens
j) phospholipids
k) derivatives of alpha-hydroxyacids
l) germicides for cosmetic use, both synthetic, such as salicylic acid and/or others, as well as natural, such as for example neem oil and/or others,
m) silicones
n) naturally occurring oils, e.g. almond oil as well as mixtures of any of the above components.

The inventive washing or cleaning agent comprises, in addition to the described microcapsules, still further ingredients, namely at least surfactants and/or builders.

In the following, further possible ingredients of the washing or cleaning agent will be described in more detail. Firstly, however, it should be made clear that the term "washing agent" in the context of this invention especially includes washing or cleaning agents as well as fabric post-treatment agents (such as preferably fabric softeners, fragrant rinses, conditioning cloths for use in laundry dryers, hygienic rinses etc.). Fabric washing agent is the name for the formulations required when washing fabrics, e.g. in the form of powders, granules, pearls, tablets, pastes, gels, cloths, pieces or liquids, which are employed preferably in aqueous solutions especially in washing machines. Fabric softeners are fabric post-treatment agents for fabric care and preferably comprise active agents that lend a soft feel to the treated fabrics, in particular cationic active agents (preferably cationic surfactants, e.g. quaternary ammonium compounds), fatty acid derivatives and/or silicone oils. Fragrant rinses are perfume-containing fabric post-treatment agents for fabric care and provide a particularly pleasant fragrance to the fabrics. Conditioning cloths for use in a laundry dryer are non-wovens or sheets that are impregnated with active agents (especially fabric softeners). Hygiene rinses are fabric post-treatment agents for fabric care and comprise at least one antimicrobial active agent, e.g. quaternary ammonium compounds such as e.g. benzalkonium chloride, and serve to reduce the germ count of the laundry. The term "cleaning agent" includes all cleaners for hard or soft surfaces, but preferably hard surfaces, wherein especially dishwasher detergents (including hand dishwasher detergents and machine dishwasher detergents), all-purpose cleaners, WC-cleaners, sanitary cleaners as well as glass cleaners may be cited. All washing or cleaning agents can be in the form of e.g. powders, granules, pearls, tablets, pastes, gels, cloths, pieces or liquids. They can be mono-phasic or multi-phasic. They can also be in single-dose packages, so-called pouches, wherein in one variant the microcapsules are embedded in the film material used for the pouch, e.g. PVA.

The inventive washing or cleaning agents comprise, in addition to the microcapsules as the essential component, surfactants and/or builders.

Anionic surfactants, non-ionic surfactants, cationic, zwitterionic and/or amphoteric surfactants are especially considered as the surfactants. However, the inventive washing or cleaning agent particularly preferably comprises anionic, non-ionic and/or cationic surfactants. The use of a mixture of anionic and non-ionic surfactants is particularly advantageous. The inventive washing or cleaning agent preferably comprises 0.05 wt % to 50 wt %, more advantageously 1 to 40 wt %, still more advantageously 3 to 30 wt % and in particular 5 wt % to 20 wt % surfactant(s), in particular from the group of the anionic surfactants, non-ionic surfactants, cationic, zwitterionic and/or amphoteric surfactants. This corresponds to a preferred embodiment of the invention and provides optimal cleaning powers.

It is particularly preferred, when the inventive washing or cleaning agent comprises anionic surfactant, advantageously in amounts of 0.1-25 wt %, more advantageously 1-20 wt %, in particular in amounts of 3-15 wt %, relative to the total agent. This corresponds to a preferred embodiment of the invention and provides particularly advantageous cleaning powers. A particularly suitable anionic surfactant is alkylbenzene sulfonate, preferably linear alkylbenzene sulfonate (LAS). If the inventive washing or cleaning agent comprises alkylbenzene sulfonate, advantageously in amounts of 0.1-25 wt %, more advantageously 1-20 wt %, in particular in amounts of 3-15 wt %, relative to the total agent, then this is a preferred embodiment of the invention.

Further particularly suitable anionic surfactants are the alkyl sulfates, in particular the fatty alcohol sulfates (FAS), such as e.g. $C_{12}$-$C_{18}$ fatty alcohol sulfate. $C_8$-$C_{18}$ Alkyl sulfates can preferably be added, $C_{13}$ alkyl sulfate as well as $C_{13-15}$ alkyl sulfate and $C_{13-17}$ alkyl sulfate are particularly preferred, advantageously branched, especially alkyl-branched $C_{13-17}$ alkyl sulfate. Particularly suitable fatty alcohol sulfates are derived from lauryl alcohol and myristyl alcohol and are therefore fatty alcohol sulfates with 12 or 14 carbon atoms. The long chain FAS-types ($C_{16}$ to $C_{18}$) are very well suited for washing at higher temperatures. Other preferred anionic surfactants that can be used are e.g. alkane sulfonates (e.g. secondary $C_{13}$-$C_{18}$ alkane sulfonate), methyl ester sulfonates (e.g. $\alpha$-$C_{12}$-$C_{18}$ methyl ester sulfonates) and $\alpha$-olefin sulfonates (e.g. $\alpha$-$C_{14}$-$C_{18}$ olefin sulfonates) and alkyl ether sulfates (e.g. $C_{12}$-$C_{14}$ fatty alcohol-2EO-ether sulfates) and/or soaps. Further suitable anionic surfactants will be described further below. However, FAS and/or LAS are particularly suitable.

The anionic surfactants, including the soaps, may be in the form of their sodium, potassium or ammonium salts or as soluble salts of organic bases, such as mono, di or triethanolamine. Preferably, the anionic surfactants are in the form of their sodium or potassium salts, especially in the form of the sodium salts.

It is particularly preferred, when the inventive washing or cleaning agent comprises non-ionic surfactant, advantageously in amounts of 0.01-25 wt %, more advantageously 1-20 wt %, in particular in amounts of 3-15 wt %, relative to the total agent. This corresponds to a preferred embodiment of the invention. The use of alkyl polyglycol ethers is particularly preferred, in particular in combination with anionic surfactant, such as preferably LAS. Further suitable non-ionic surfactants are alkylphenol polyglycol ethers (APEO), (ethoxylated) sorbitol fatty acid esters (sorbitanes), alkyl polyglucosides (APG), fatty acid glucamides, fatty acid ethoxylates, amine oxides, ethylene oxide-propylene oxide block copolymers, polyglycerol fatty acid esters and/or fatty acid alkanolamides. Further suitable non-ionic surfactants will be described further below. Non-ionic surfactants based on sugars, such as especially APG, are particularly preferred.

In the context of the invention, the builders include in particular zeolites, polycarboxylates, citrates (e.g. sodium citrate), soda, sodium hydrogen carbonate, phosphates, sodium silicates (water glass), phosphonates, alkaline amorphous disilicates as well as crystalline layered silicates. The inventive washing or cleaning agent preferably comprises builders in amounts of 0.1 to 80 wt %, advantageously 1 to 60 wt %, more advantageously 5 to 60 wt %. Furthermore, it is quite particularly preferred that the inventive washing or cleaning agent comprises a builder system (i.e. at least 2 substances having a builder effect), preferably a zeolite-containing builder system, preferably containing zeolite in amounts >1 wt ° A, more advantageously >5 wt %, further advantageously >10 wt %, especially >15 wt %, the wt % being relative to the total agent. A reasonable upper limit for zeolite can be e.g. 40 wt %, 30 wt % or 20 wt %, relative to the total agent. This corresponds to a preferred embodiment of the invention. A combination of zeolite with soda is preferred. The terms builder and builder substance are synonymous.

It is likewise particularly preferred if the inventive washing or cleaning agent comprises a soluble builder system, preferably containing soda, silicate, citrate and/or polycarboxylates, advantageously in amounts of 0.1 to 50 wt %, relative to the total agent. This corresponds to a preferred embodiment of the invention. If such a soluble builder system is comprised, then it is extremely preferred if only minor amounts of insoluble builder, such as in particular zeolite, are comprised, e.g. <5 wt % to 0.1 wt %; in such cases especially no insoluble builder is comprised at all.

It is likewise possible that the inventive washing or cleaning agent comprises phosphate, wherein phosphate is preferably comprised in amounts of 1-40 wt %, in particular 5-30 wt %, relative to the total agent. However, according to another preferred embodiment, the inventive washing or cleaning agent is free of phosphates.

The inventive washing or cleaning agents, which e.g. can be present in particular as powdery solids, in the form of post-compacted particles, as homogeneous solutions or suspensions, in principle can additionally comprise all known and customary ingredients for such agents. The inventive agents, as has already been shown, can comprise in particular builder substances, surfactants, also bleaching agents, bleach activators, water-miscible organic solvents, enzymes, sequestering agents, electrolytes, pH-regulators and additional auxiliaries, such as optical brighteners, fluorescent agents, anti-greying inhibitors, shrink preventers, anti-crease agents, color transfer inhibitors, antimicrobials, germicides, fungicides, antioxidants, preservatives, corrosion inhibitors, glass-corrosion inhibitors, disintegration auxiliaries, antistats, bittering agents, ironing aids, water repellants and impregnation agents, swelling and non-skid agents, neutral filling salts as well as UV-protection agents, foam regulators as well as dyes and fragrances.

The inventive washing and cleaning agents can also additionally comprise so-called free, perfume oils (fragrances) that are not micro-encapsulated. This corresponds to a particularly preferred embodiment of the invention. The composition of these perfume oils can be the same or different as the encapsulated perfume oils. Based on the total washing or cleaning agent, preferably 0.0001 to 15 wt %, advantageously 0.001 to 10 wt %, especially 0.01 to 5 wt % fragrances can be comprised therein.

Another subject matter of the invention is a method for manufacturing a solid washing or cleaning agent characterized (a) by blending a microcapsule dispersion, containing microcapsules, whose capsule walls contain a resin that is obtainable by treating
  a) at least one aromatic alcohol or its ethers or derivatives with
  b) at least one aldehydic component that possesses at least two carbon atoms per molecule, and
  c) optionally in the presence of at least one (meth)acrylate polymer, into the rest of the washing or cleaning agent matrix, or (b) by blending the cited microcapsules in granulated or supported form into the rest of the washing or cleaning agent matrix, or (c) by blending the cited microcapsules in granulated or dried form into the rest of the washing or cleaning agent matrix.

For manufacturing inventively employable agents with an increased bulk density, particularly in the range of 650 g/l to 950 g/l, a preferred process is one with an extrusion step and the granulation.

For manufacturing the inventive agents in tablet form, which can be monophasic or multiphasic, monocolored or multicolored and especially consisting of one or more layers, especially of two layers, all the ingredients—optionally for each layer—are preferably mixed together in a mixer and the mixture is compressed using conventional tablet presses, e.g. exocentric presses or rotating presses. Particularly for the case of multilayer tablets, it can be advantageous to precompress at least one layer. In this trouble-free way, tablets are obtained that are break-proof and nevertheless fast dissolving under conditions of use. The tablets may be any shape—round, oval or cornered—intermediate shapes also being possible. Corners and edges are preferably rounded off.

Liquid or pasty inventive agents in the form of solutions in standard solvents are generally prepared by a simple mixing of the ingredients, which can be added as is or as a solution into an automatic mixer. The inventive microcapsules can e.g. be subsequently suspended into the otherwise "finished" composition.

Another subject matter of the invention is a process for manufacturing a liquid washing or cleaning agent, wherein a microcapsule dispersion that contains microcapsules, whose capsule walls contain a resin that is obtained by treating a) at least one aromatic alcohol or its ethers or derivatives with
b) at least one aldehydic component that possesses at least two carbon atoms per molecule, and
c) optionally in the presence of at least one (meth)acrylate polymer, is stirred into the liquid washing or cleaning agent matrix or the cited microcapsule dispersion is continuously added to a liquid washing or cleaning agent matrix and blended with static mixing elements, wherein surfactant was preferably added beforehand to the microcapsule dispersion.

For the manufacture of the inventive washing or cleaning agent, be it solid or liquid, it is generally advantageous to introduce the microcapsules in the form of a microcapsule slurry (aqueous dispersion of the microcapsules). It has proven very advantageous in this regard to add surfactant to the microcapsule slurry to stabilize the latter, wherein cationic, anionic and/or non-ionic surfactant is added as the surfactant, preferably non-ionic surfactant, especially ethoxylated oxo alcohol is suitable. These kinds of stabilized microcapsule slurries have better processability. Otherwise the processability of the microcapsule slurry can be hindered by a reversible flocculation.

In this respect, anionic surfactants can be advantageously added in amounts of 1 to 40 wt %, for example 2 to 30 wt %, especially 3 to 20 wt % for stabilizing the dispersion, the wt % being relative to the total dispersion. Cationic surfactants can be advantageously added in amounts of 0.001 to 4 wt %, for example 0.01 to 3 wt % and especially 0.1 to 2 wt % for stabilizing the dispersion, the wt % being relative to the total dispersion. Non-ionic surfactants can be advantageously added, in amounts of 0.01 to 20 wt %, for example 0.1 to 15 wt %, especially 1 to 10 wt % for stabilizing the dispersion, the wt % being relative to the total dispersion. Suitable anionic surfactants are e.g. alkylbenzene sulfonates, preferably $C_{10}$-$C_{13}$ n-alkylbenzene sulfonate, alkane sulfonate, methyl ester sulfonates, α-olefin sulfonates, alkyl sulfates, preferably fatty alcohol sulfate, alkyl ether sulfates, preferably fatty alcohol ether sulfate and sulfo succinates. Suitable cationic surfactants are e.g. quaternary ammonium compounds, especially quaternary ammonium compounds with one or two hydrophobic alkyl groups, quaternary phosphonium salts or tertiary sulfonium salts. The so-called esterquats are particularly preferred. The term esterquat stands for a collective name for cationic surface active compounds containing preferably two hydrophobic groups which are linked through ester bonds with a quaternized di(tri)ethanolamine or with an analogous compound.

The use of non-ionic surfactants to stabilize aqueous microcapsule dispersions has proven to be particularly advantageous. Fatty alcohol ethoxylates, oxo alcohol ethoxylates, alkylphenol polyglycol ethers, fatty acid ethoxylates, fatty amine ethoxylates, ethoxylated triacylglycerols and mixed ethers (alkylated polyethylene glycol ether on both sides) as well as alkyl polyglucosides, saccharose esters, sorbitol esters, fatty acid glucamides as well as amine oxides are particularly advantageously usable.

The use of oxo alcohol ethoxylates is however particularly advantageous in regard to the desired stabilization of the microcapsule dispersions. In the context of the invention they provide the best results. Preferred oxo alcohol ethoxylates are derived from oxo alcohols with 9 to 15 carbon atoms, onto which preferably 3 to 15 moles of ethylene oxide have been added. A particularly preferred oxo alcohol ethoxylate in the context of the invention is $C_{13}$-$C_{15}$ oxo alcohol, onto which 7 moles of ethylene oxide have been added. A suitable commercial product is e.g. Lutensol® AO 7 from BASF. The addition of oxo alcohol ethoxylates can completely suppress the reversible flocculation.

The above described stabilized microcapsule dispersions are particularly advantageous when manufacturing liquid washing or cleaning agents. An inventive process, as described above, in which a liquid washing or cleaning agent is mixed with a microcapsule dispersion, preferably by stirring the microcapsule dispersion into the washing or cleaning agent matrix or by the continuous addition into a liquid washing or cleaning agent and blending through a static mixing element, therefore corresponds to a preferred embodiment of the invention.

The stabilized microcapsule dispersions are also similarly advantageous when manufacturing solid washing or cleaning agents. An inventive process, as described above, in which a solid washing or cleaning agent is mixed with a microcapsule dispersion, e.g. by spraying the microcapsule dispersion onto the solid washing or cleaning agent matrix or onto washing or cleaning agent granules, therefore corresponds to a preferred embodiment of the invention.

A process for manufacturing a solid washing or cleaning agent, in which the microcapsule dispersion is granulated prior to blending with a washing or cleaning agent, is also particularly advantageous.

Another subject matter of the invention is a method for washing fabrics by employing an inventive washing or cleaning agent (as described above), preferably in an automatic washing machine, wherein the wash temperature is <60° C., preferably <40° C.

Preferred inventive washing or cleaning agents are fabric post-treatment agents. These also comprise the inventively incorporated microcapsules as well as surfactants and/or builders. It is preferably a fabric softener, i.e. fabric post-treatment agents that comprise a cationic surfactant. Esterquats are the preferred comprised cationic surfactants. Esterquats are quaternary ammonium compounds with preferably two hydrophobic groups that each comprise an ester group as the so-called predetermined breakage point for an easier biodegradation. The amount of cationic surfactant is preferably 2-80 wt %, advantageously 4-40 wt %, more preferably 6 to 20 wt % and particularly 8-15 wt %, in each case relative to the total agent. Polyquaternized polymers (e.g. Luviquat Care from BASF) and also cationic biopolymers based on chitin and its derivatives, for example the polymer obtained under the trade name Chitosan® (manufacturer: Cognis) can also be employed as the cationic surfactants.

Another subject matter of the invention is a fabric conditioning method using an inventive fabric post-treatment agent (as described above) in the rinse cycle of an automatic washing machine.

Another subject matter of the invention is a fabric drying method using an inventive washing or cleaning agent in an automatic laundry dryer.

Another subject matter of the invention is a fabric conditioning method using an inventive fabric post-treatment agent in the form of a conditioning substrate in an automatic laundry dryer.

Another subject matter of the invention is in the use of an inventive fabric post-treatment agent for conditioning textile fabrics.

In the context of the invention, preferred agents are also cleaning agents, especially cleaners for hard surfaces. These also comprise the inventively incorporated microcapsules as well as surfactants and/or builders. In connection with the automatic dishwasher detergents, fragrance delivery systems are also included as cleaning auxiliaries in the context of the invention; they include a vessel as well as particles for deodorization and scenting the automatic dishwasher, wherein these particles contain fragrance-containing microcapsules.

When the inventive cleaning agent is selected from the group of the hand dishwasher detergents, the machine dishwasher detergents), the toilet cleaners or WC-cleaners, the pipe cleaning agents or drain cleaners, the universal or all-purpose cleaners, the sanitary cleaners, the oven cleaners or grill cleaners, the metal polishes, the glass cleaners or window cleaners, the cleaning auxiliaries, the floor cleaners and the special cleaning agents, then there exists a preferred embodiment of the invention.

An advantage of the invention in connection with the cleaning agents is that of also providing a retarded and/or controlled release of liquids, such as e.g. fragrances, from the comprised microcapsules. In this way a frequently desired "slow release" effect or "long-lasting" effect and/or an accurate release of active agent is provided. The cleaned surface, e.g. a floor, remains uniformly fragrant for a longer time or fragrances are released when the deposited microcapsules are broken open by mechanical force. Similarly, other incorporated liquids, such as e.g. liquids with antimicrobial active agents, germicides, fungicides or other active agents can also be subjected to a retarded and/or controlled release, e.g. by the action of mechanical force.

A further subject matter of the present invention is a particulate washing or cleaning agent additive, containing the already described inventively utilizable microcapsules as well as surfactants and/or builders.

It has now been found that when these inventive particles, as described above, are used, and if they contain fragrance, then a particularly advantageous fragrant impression (increased pleasure/higher intensity/better permanence) can be achieved when washing or cleaning surfaces, especially of fabrics. Retarded and/or controlled release of fragrance is enabled.

Another subject matter of the invention is in the use of an inventive washing or cleaning agent in a washing or cleaning method for depositing microcapsules onto the treated objects (surfaces) so as to enable the controlled release of preferably liquid active agents, such as in particular fragrances, onto the objects by mechanical stimulation.

Another subject matter of the invention is in the use of an inventive washing or cleaning agent in a washing or cleaning method for depositing microcapsules onto the treated objects (surfaces) so as to enable the long-lasting release of preferably liquid active agents, such as in particular fragrances, onto the objects by diffusion.

EXAMPLES

I. Synthesis Examples

Example I.1

Production of Copolymers a) AMPS-Hydroxybutyl Acrylate

For the 1500 g batch, 891 g of deionized water together with 585 g AMPS (50% aqueous solution) and 7.5 g 4-hydroxybutyl acrylate (HBA) were fed into the reactor and placed under an atmosphere of inert gas. The reaction mixture was heated to 75° C. with stirring (400 rpm). When the mixture reached the reaction temperature, 0.03 g of the water-soluble initiator sodium peroxydisulfate, dissolved in 15 g water, was injected into the reactor by means of a syringe. After the maximum temperature was attained, there began an hour of continued reaction. The batch was then cooled down to room temperature and 1.5 g of preservative was added.

The aqueous solution was characterized by the viscosity, solids content and the pH. The viscosity was 540 mPas (Brookfield measured at 20 rpm), the solids content was 21% and the pH was 3.3. 3 g of copolymer were deposited on a Petri dish and dried for 24 hours at 160° C. in the drying oven. The resulting weight was 0.69 g, corresponding to a yield of 21.6%.

b) AMPS-Polyalkylene Glycol Monomethacrylate

The reaction mixture consisted of 912 g deionized water, 240 g AMPS and 7.5 g poly(ethylene/propylene) glycol monomethacrylate (Bisomer PEM 63P HD from Cognis, CAS-Nr. 589-75-9). The mixture was placed under an atmosphere of inert gas. The reaction mixture was heated to 75° C. with stirring (400 rpm). Into the reactor was injected a solution of 1.5 g sodium peroxydisulfate in 15 g water by means of a syringe. Once the temperature in the reactor had reached a maximum and had begun to drop, 240 g AMPS with 83 g PEM 63P HD were metered in by means of a peristaltic pump over a period of one hour. The reaction was then allowed to proceed for half an hour. The batch was then cooled down to room temperature and 1.5 g of preservative was added.

The aqueous solution was characterized by the viscosity, solids content and the pH. The viscosity was 110 mPas (Brookfield measured at 20 rpm), the solids content was 23% and the pH was 3.1. 3 g of copolymer were deposited on a Petri dish and dried for 24 hours at 160° C. in the drying oven. The resulting weight was 0.68 g, corresponding to a yield of 21.6%.

Example I.2

Resorcinol Capsules

In a 400 ml beaker were dissolved with stirring (stirring speed: about 1500 rpm) 5.5 g resorcinol in 70 g water, and then 2.0 g sodium carbonate solution (20 wt conc.) were added, whereupon the pH was ca. 7.9. This solution was heated to a temperature of about 52° C. 25.5 g of glutaraldehyde was then added.

The mixture was then stirred at a temperature of about 52° C. for ca. 10 minutes at a stirring speed of about 1500 rpm (pre-condensation time). About 20 g of water were added and ca. 2 minutes later 1 g of one of the protective colloids a) copolymer I.1 a, b) copolymer I.1 b and c) poly-AMPS (AMPS homopolymer) and again ca. 2 minutes later 55 g butylphenyl acetate (CAS-Nummer 122-43-0; fragrance with a honey-like odor) were added. Immediately afterwards the stirring speed was increased to about 4000 rpm and at approximately the same time 20.0 g sodium carbonate solution (20 wt conc.) was added The pH of the mixture was then about 9.7. The viscosity and the volume of the mixture then increased. Stirring was continued at about 4000 rpm until the viscosity again dropped. The stirring speed was then lowered to about 1500 rpm. The batch was then stirred at a temperature of about 52° C. at about the same speed for a further 60 minutes. This phase is called the quiescent phase. At the end of this phase the mixture was heated to ca. 80° C. and the capsules were cured at this temperature for a period of 3 hours.

Capsule size distribution—D (90) 5-10 μm; encapsulation efficiency ca. 90%;

Dry yield >90%; solids in the slurry ca. 40 wt %.

The resulting capsules were free of formaldehyde and could be processed without problems from the aqueous slurry as the stable core/shell microcapsules to afford a dry free-flowing powder.

Instead of butylphenyl acetate, the capsules can also be loaded with other gaseous, liquid or solid hydrophobic materials and classes of substances, in particular with fragrances or perfume oils.

In addition to the butylphenyl acetate-containing resorcinol microcapsules of the example I.2, additional microcapsules were manufactured according to analogous processes:

Example I.3

Hydroxycitronellal-Containing Resorcinol Microcapsules,

Example I.4

Helional-Containing Resorcinol Microcapsules,

Example I.5

Citral-Containing Resorcinol Microcapsules,

Example I.6

Bourgeonal-Containing Resorcinol Microcapsules,

Example I.7

Triplal-Containing Resorcinol Microcapsules,

Example I.8

Ligustral-Containing Resorcinol Microcapsules,

Example I.9

Vertocitral-Containing Resorcinol Microcapsules,

Example I.10

Florhydral-Containing Resorcinol Microcapsules,

Example I.11 citronellal-containing resorcinol microcapsules,

Example I.12

Citronellyloxyacetaldehyde-Containing Resorcinol Microcapsules.

Phloroglucinol microcapsules were manufactured in a further series of examples. In analogy to the process of example I.2., 6.3 g of pholoroglucinol totally replaced the 5.5 g of resorcinol. Consequently, this resulted in:

Example I.13

Butylphenyl Acetate-Containing Phloroglucinol Microcapsules,

Example I.14

Hydroxycitronellal-Containing Phloroglucinol Microcapsules,

Example I.15

Helional-Containing Phloroglucinol Microcapsules,

Example I.16

Citral-Containing Phloroglucinol Microcapsules,

Example I.17

Bourgeonal-Containing Phloroglucinol Microcapsules,

Example I.18

Triplal-Containing Phloroglucinol Microcapsules,

Example I.19

Ligustral-Containing Phloroglucinol Microcapsules,

Example I.20

Vertocitral-Containing Phloroglucinol Microcapsules,

Example I.21

Florhydral-Containing Phloroglucinal Microcapsules,

Example I.22

Citronellal-Containing Phloroglucinol Microcapsules,

Example I.23

Citronellyloxyacetaldehyde-Containing Phloroglucinol microcapsules,

In both of the series of examples I.3 to I.12 (resorcinol) or I.13 to I.23 (phloroglucinol) for the synthesis of the microcapsules, 21.9 g of succindialdehyde can replace 25.5 g of glutaraldehyde. The corresponding succindialdehyde-based resorcinol microcapsules and phloroglucinol microcapsules were manufactured in the series of examples I.24 to I.34 (resorcinol and glutaraldehyde) and I.35 to I.45 (phloroglucinol and glutaraldehyde).

II. Examples of Use

Example II.1

Liquid Conditioner:

| | wt % |
|---|---|
| Esterquat[a] | 22.5 |
| Silicone oil | 5 |
| $MgCl \times 6H_2O$ | 0.5 |
| Perfume | 1.6 |
| Microcapsules[c] | 0.5 |
| Water, deionized | ad 100 |

[a]N-Methyl-N(2-hydroxyethyl)-N,N-(ditallowacyloxyethyl)ammonium methosulfate
[c]Perfume-containing resorcinol microcapsules obtained by treating resorcinol with glutardialdehyde according to Example I.2.

The formulation was manufactured by melting the esterquat in water. The molten esterquat was then stirred with a high dispersion device and the remaining components were added. After the mixture was cooled down to below 30° C., the perfume and the microcapsules were added with light stirring.

Example II.2

Conditioner Substrate

For the manufacture of the conditioner substrate, cellulose non-wovens (surface: 24.5×39 cm) were impregnated with 20 g of the liquid conditioner of Example II.1.

Example II.3

Liquid Cleaning Agent

| Raw material | Quantity in wt % |
|---|---|
| C12-18 Fatty acid, Na salt | 0.7 |
| C10-13 Alkylbenzene sulfonate | 6.4 |
| Sodium citrate | 1.5 |
| Sodium carbonate | 3.0 |
| Ethanol | 2.1 |
| Cumene sulfate, Na | 1.5 |
| C12-18 Fatty alcohol + 7EO | 1.5 |
| C8 Fatty alcohol sulfate, Na salt | 1.5 |
| Microcapsules[c] | 0.5 |
| Perfume | 0.7 |
| Water | ad 100 |

[c]Perfume-containing resorcinol microcapsules obtained by treating resorcinol with glutardialdehyde according to Example I.2.

Example II.5

Liquid Washing Agent

| Raw material | Quantity in wt % |
|---|---|
| C12-14 Fatty acid | 8.8 |
| C12-18 Fatty alcohol + 7EO | 24.0 |

-continued

| Raw material | Quantity in wt % |
|---|---|
| Alkyl polyglucoside | 2.0 |
| C12-14-2EO-sulfate | 5.0 |
| C16-18 Fatty acid | 6.8 |
| NaOH 50% | 3.0 |
| Citric acid × 1 $H_2O$ | 1.0 |
| Glycerin 99.5% | 7.5 |
| Ethanol | 1.0 |
| Silicone oil | 0.3 |
| Polyvinyl pyrrolidone | 0.5 |
| HEDP-4Na | 0.5 |
| Enzyme, Dye, Perfume, | 0.8 |
| Microcapsules[c] | 0.7 |
| Water | ad 100 |

[c]Perfume-containing resorcinol microcapsules obtained by treating resorcinol with glutardialdehyde according to Example I.2.

Example II.6

Solid Washing Agent

| Raw material | Quantity in wt % |
|---|---|
| Alkylbenzene sulfonate (Na salt) | 12 |
| Carboxymethyl cellulose | 1 |
| Enzyme | 1 |
| Non-ionic surfactant | 3 |
| (1-Hydroxyethylidene)bisphosphonate | 1 |
| Sodium carbonate | 25 |
| Sodium percarbonate | 12 |
| Sodium sulfate | 27 |
| Polyacrylate | 3 |
| Defoamer | 2 |
| N,N,N',N'-Tetraacetylethylenediamine | 3 |
| Water | 3 |
| Perfume, | 0.15 |
| Microcapsules[c] | 1.0 |
| Sodium silicate | ad 100 |
| Sum | 100 |

[c]Perfume-containing resorcinol microcapsules obtained by treating resorcinol with glutardialdehyde according to Example I.2.
Sodium silicate: amorphous sodium silicate with $Na_2O$: $SiO_2$ = 2.4
Polyacrylate: polyacrylic acid, sodium salt; M = 4500 g/mol

Example II.7

Washing Agent Gel

| Raw material | Quantity in wt % |
|---|---|
| Alkyl polyglucoside | 2.0 |
| C12-14 soap, Na | 8.80 |
| C16-18 soap, Na | 6.80 |
| NaOH 50% | 3.00 |
| Citric acid × 1$H_2O$ | 1.00 |
| Glycerin 99.5% | 7.50 |
| Ethanol | 1.00 |
| Silicone defoamer | 0.30 |
| Boric acid | 1.00 |
| 1-Hydroxyethylenediphosphonic acid | 0.50 |
| Vinyl imidazole-vinyl pyrrolidone copolymer | 1.67 |
| Perfume, | 1.3 |
| Microcapsules[c] | 0.8 |
| Water | ad 100 |

[c]Perfume-containing resorcinol microcapsules obtained by treating resorcinol with glutardialdehyde according to Example I.2.

Example III.8

Ironing Spray

| Raw material | Quantity in wt % |
|---|---|
| Ethanol | 2 |
| Hydrogen peroxide | 0.01 |
| Perfume | 0.05 |
| Microcapsules[c] | 0.02 |
| Water with 5° dH | ad 100 wt % |

[c]Perfume-containing resorcinol microcapsules obtained by treating resorcinol with glutardialdehyde according to Example I.2.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A washing or cleaning agent, comprising i. at least one component selected from the group consisting of surfactants and builders; and ii. microcapsules having capsule walls consisting of resin made from a) at least one component selected from the group consisting of aromatic alcohols and aromatic ethers;

b) at least one aldehydic component that comprises at least two carbon atoms per molecule, and c) at least one meth(acrylate) polymer, wherein the (meth)acrylate polymer is selected from the group consisting of homopolymers and copolymers of polar-functionalized (meth) acrylate monomers wherein the molar ratio of component a) to component b) is from 1:1 to 1:5, and wherein the molar ratio of components a)+b) to component c) is from 1:1 and 1:0.01.

2. The agent according to claim 1, wherein the aromatic alcohols are selected from phenols, o-cresol, m-cresol, p-cresol, α-naphthol, β-naphthol, thymol, pyrocatechol, resorcinol, hydroquinone, 1,4-naphthohydroquinone, phloroglucine, pyrogallol, and hydroxyhydroquinone.

3. The agent according to claim 1, wherein the aldehydic component is selected from valeraldehyde, capronaldehyde, caprylaldehyde, decanal, succindialdehyde, cyclohexane carbaldehyde, cyclopentane carbaldehyde, 2-methyl-1-propanal, 2-methylpropionaldehyde, acetaldehyde, acrolein, aldosterone, antimycin A, 8'-apo-β-caroten-8'-al, benzaldehyde, butanal, chloral, citral, citronellal, crotonaldehyde, dimethylaminobenzaldehyde, folic acid, fosmidomycin, furfural, glutaraldehyde, glycerin aldehyde, glycolaldehyde, glyoxal, glyoxylic acid, heptanal, 2-hydroxybenzaldehyde, 3-hydroxybutanal, hydroxymethylfurfural, 4-hydroxynonenal, isobutanal, iso-butyraldehyde, methacrolein, 2-methylundecanal, mucochloric acid, N-methylformamide, 2-nitrobenzaldehyde, nonanal, octanal, oleocanthal, orlistat, pentanal, phenylethanal, phycocyanin, piperonal, propanal, propenal, protocatechualdehyde, retinal, salicyl aldehyde, secologanin, streptomycin, strophanthidin, tylosin, vanillin, and cinnamic aldehyde.

4. The agent according to claim 1, wherein microcapsules comprise 0.0001 to 50 wt %, based on the total agent.

5. The agent according to claim 1, comprising 0.05 wt % to 50 wt % surfactant(s) selected from the group consisting of anionic surfactants, non-ionic surfactants, cationic, zwitterionic and amphoteric surfactants, based on the total agent.

6. The agent according to claim 1, comprising 0.01 to 25 wt % non-ionic surfactant, based on the total agent.

7. The agent according to claim 1, comprising 0.1 to 80 wt % builder, based on the total agent.

8. The agent according to claim 7, where in the builder is a soluble builder system, comprising at least one of the group consisting of sodas, silicates, citrates and polycarboxylates.

9. The agent according to claim 1, wherein the microcapsules further comprise fragrance.

10. A process for manufacturing a liquid laundry or cleaning agent wherein a microcapsule dispersion that contains microcapsules, whose capsule walls consist of a resin that is made by reacting a) at least one component selected from the group consisting of aromatic alcohols and aromatic ethers; with b) at least one aldehydic component that comprises at least two carbon atoms per molecule, and c) in the presence of at least one (meth)acrylate polymer, wherein the (meth) acrylate polymer is selected from the group consisting of homopolymers and copolymers of polar-functionalized (meth) acrylate momomers, wherein the molar ratio of component a) to component b( is from 1:1 to 1:5, and wherein the molar ratio of components a)+b) to component c) is from 1:1 and 1:0.01, is added into a liquid laundry matrix comprising at least one component selected from the group consisting of surfactants and builders.

* * * * *